US011508200B2

(12) United States Patent
Yokawa

(10) Patent No.: US 11,508,200 B2
(45) Date of Patent: Nov. 22, 2022

(54) BANKNOTE PROCESSING APPARATUS

(71) Applicant: GLORY LTD., Hyogo (JP)

(72) Inventor: Takeshi Yokawa, Hyogo (JP)

(73) Assignee: GLORY LTD., Hyogo (JP)

( * ) Notice: Subject to any disclaimer, the term of this patent is extended or adjusted under 35 U.S.C. 154(b) by 575 days.

(21) Appl. No.: 16/493,481

(22) PCT Filed: Feb. 28, 2018

(86) PCT No.: PCT/JP2018/007506
§ 371 (c)(1),
(2) Date: Sep. 12, 2019

(87) PCT Pub. No.: WO2018/168465
PCT Pub. Date: Sep. 20, 2018

(65) Prior Publication Data

US 2020/0134957 A1 Apr. 30, 2020

(30) Foreign Application Priority Data

Mar. 15, 2017 (JP) ..... JP2017-049787

(51) Int. Cl.
*G07D 11/40* (2019.01)
*G07D 11/125* (2019.01)
(Continued)

(52) U.S. Cl.
CPC ..... *G07D 11/40* (2019.01); *E05G 1/04* (2013.01); *E05G 1/06* (2013.01); *G07D 11/009* (2013.01); *G07D 11/125* (2019.01)

(58) Field of Classification Search
CPC ..... G07D 11/10; G07D 11/12; G07D 11/125; G07D 11/13; G07D 11/135; G07D 11/16;
(Continued)

(56) References Cited

U.S. PATENT DOCUMENTS 8,708,127 B2 * 4/2014 Roosch ..... G07D 11/40 109/58
9,390,594 B2 * 7/2016 Levenick ..... G07F 19/202
(Continued)

FOREIGN PATENT DOCUMENTS

EP 3032506 A1 6/2016
JP 2002-163704 6/2002
(Continued)

OTHER PUBLICATIONS

Office Action in counterpart European Patent Application No. 18766838.9, dated Aug. 5, 2021.
(Continued)

*Primary Examiner* — Thien M Le
*Assistant Examiner* — April A Taylor
(74) *Attorney, Agent, or Firm* — Greenblum & Bernstein, P.L.C.

(57) ABSTRACT

This banknote processing apparatus has: an upper unit including a depositing unit configured to deposit a banknote in the banknote processing apparatus and a banknote recognition unit configured to recognize the banknote deposited from the depositing unit; and a lower unit including a temporary storage unit configured to temporarily store the banknote recognized by the banknote recognition unit and a banknote storage unit configured to store the banknote stored in the temporary storage unit. Thus, the temporary storage unit is housed in the lower unit, and therefore a user can easily perform maintenance of the temporary storage unit.

7 Claims, 8 Drawing Sheets

(51) Int. Cl.

| | |
|---|---|
| ***E05G 1/04*** | (2006.01) |
| ***E05G 1/06*** | (2006.01) |
| ***G07D 11/00*** | (2019.01) |

(58) Field of Classification Search

CPC ..... G07D 11/26; G07D 11/40; G07F 19/20; G07F 19/201; G07F 19/202; G07F 19/203; G07F 19/205; E05G 1/04; E05G 1/06

See application file for complete search history.

(56) References Cited

U.S. PATENT DOCUMENTS

| | | | | |
|---|---|---|---|---|
| 9,631,414 | B2 * | 4/2017 | Kamrath | E05G 1/00 |
| 9,911,265 | B2 * | 3/2018 | Lee | B65H 43/04 |
| 2002/0074709 | A1 | 6/2002 | Kanagawa | |
| 2002/0092905 | A1 | 7/2002 | Katou et al. | |
| 2002/0100399 | A1 * | 8/2002 | Young | G07D 11/125 109/24.1 |
| 2004/0134839 | A1 * | 7/2004 | Kobayashi | G07F 19/202 902/12 |
| 2007/0257099 | A1 | 11/2007 | Graef et al. | |
| 2008/0149009 | A1 | 6/2008 | Boyes | |
| 2011/0279225 | A1 | 11/2011 | Frontino et al. | |
| 2015/0015397 | A1 | 1/2015 | Lawver et al. | |
| 2015/0243119 | A1 | 8/2015 | Hayashi et al. | |
| 2016/0125374 | A1 | 5/2016 | Smith et al. | |
| 2016/0163144 | A1 * | 6/2016 | Lee | G07D 11/25 271/3.15 |

FOREIGN PATENT DOCUMENTS

| | | |
|---|---|---|
| JP | 2004-254480 | 9/2004 |
| JP | 2013-120399 | 6/2013 |
| JP | 2015-158730 | 9/2015 |
| JP | 6042950 | 10/2015 |
| JP | 2016-192129 | 11/2016 |
| JP | 2016-200976 | 12/2016 |
| KR | 10-1479459 | 1/2015 |

OTHER PUBLICATIONS

European Extended Search Report issued in counterpart EP Patent Application No. 18766838, dated Dec. 7, 2020.

International Search Report issued in International Bureau of WIPO Patent Application No. PCT/JP2018/007506, dated May 22, 2018.

Summons to attend oral proceedings in counterpart European Patent Application No. 18 768 838.9, dated Feb. 2, 2022.

* cited by examiner

BANKNOTE PROCESSING APPARATUS

TECHNICAL FIELD

The present invention relates to a banknote processing apparatus.

BACKGROUND ART

Some conventional banknote processing apparatuses are roughly divided into a processing unit at an upper portion, a first safe unit at an intermediate portion, and a second safe unit at a lower portion. In such a banknote processing apparatus, the processing unit at the upper portion contains various devices such as a depositing unit, a dispensing unit, a transport unit, a recognition unit, and a temporary storage unit (refer to PTL 1, for example).

CITATION LIST

Patent Literature

PTL 1
Japanese Patent No. 6042950

SUMMARY OF INVENTION

Technical Problem

However, in PTL 1, due to the aforementioned various devices incorporated in the processing unit at the upper portion, the processing unit at the upper portion is overcrowded with the various devices thereinside, and there is a problem of difficulty in accessing the temporary storage unit.

An object of the present invention is to provide a technique to facilitate the access to the temporary storage unit.

Solution to Problem

A banknote processing apparatus of the present invention comprises: an upper unit including a depositing unit and a banknote recognition unit, the depositing unit being configured to deposit a banknote in the banknote processing apparatus, the banknote recognition unit being configured to recognize the banknote deposited from the depositing unit; and a lower unit including a temporary storage unit and a banknote storage unit, the temporary storage unit being configured to temporarily store the banknote recognized by the banknote recognition unit, the banknote storage unit being configured to store the banknote stored in the temporary storage unit.

Advantageous Effects of Invention

According to the present invention, access to a temporary storage unit is facilitated.

DESCRIPTION OF EMBODIMENTS

Embodiments of the present invention will be described with reference to the accompanying drawings.

Embodiment 1

Figure 1:
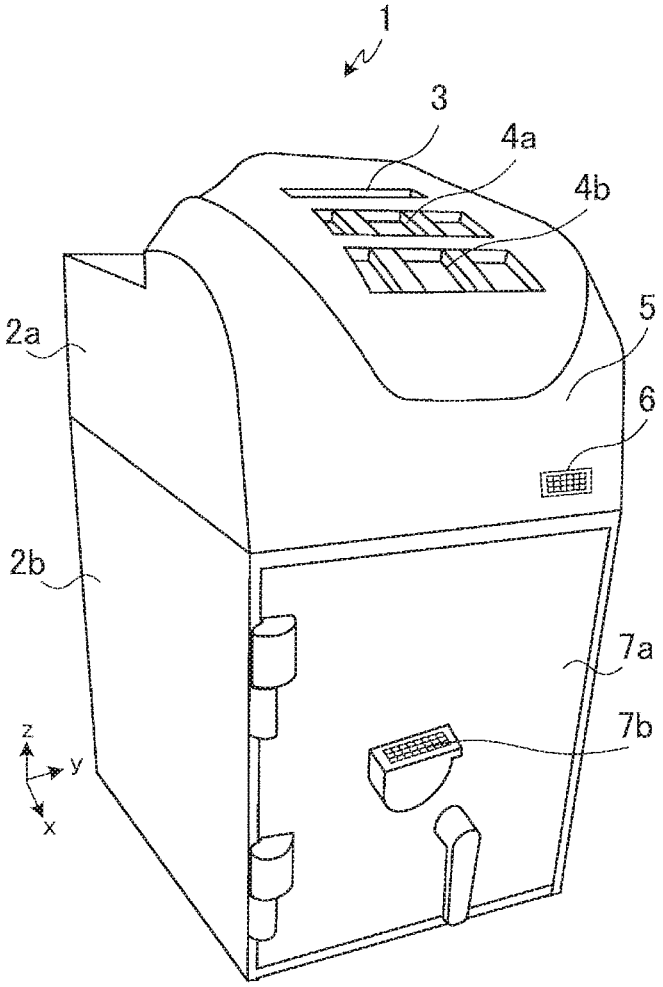
FIG. 1 is a perspective view of a banknote processing apparatus according to Embodiment 1.

FIG. 1 is a perspective view of a banknote processing apparatus 1 according to Embodiment 1. The banknote processing apparatus 1 illustrated in FIG. 1 is used in a field in which a lot of cash is handled, such as a bank and a supermarket. For example, the banknote processing apparatus 1 is used for deposit and dispensing, counting, storage management, and the like of cash in work for receipts and disbursements at a bank counter, work for proceeds from sales at a supermarket, or the like. Hereinafter, a rectangular coordinate system having x, y and z axes illustrated in FIG. 1 is set with respect to the banknote processing apparatus 1.

As illustrated in FIG. 1, the banknote processing apparatus 1 is divided into an upper unit 2*a* and a lower unit 2*b*.

The upper unit 2*a* has a depositing unit 3, dispensing units 4*a*, 4*b*, an upper cover 5, and a locking unit 6. The depositing unit 3 is an inlet into which a banknote to be deposited in the banknote processing apparatus 1 is put. The dispensing units 4*a*, 4*b* each are an outlet from which a banknote dispensed from the banknote processing apparatus 1 is taken out. The dispensing units 4*a*, 4*b* each are an outlet from which a rejected banknote, a banknote which cannot be recognized, or the like is taken out.

The upper cover 5 is a cover that covers at least a front surface of the upper unit 2*a*. The upper cover 5 is fixed to a body of the upper unit 2*a* and locked by the locking unit 6. Once the locking unit 6 is unlocked, the upper cover 5 can be drawn out forward from the body of the upper unit 2*a* together with various devices (for example, refer to the depositing unit 3, the dispensing units 4*a*, 4*b*, a control unit 11, a transport unit 12, or a recognition unit 13 illustrated in FIG. 2) in the upper unit 2*a*, which will be described below.

The locking unit 6 is provided on a front surface of the upper cover 5. The locking unit 6 is, for example, an electronic lock, and limits access to the inside of the upper unit 2*a*. For example, when a preset personal identification number which serves as the unlocking information is input to the locking unit 6, the locking unit 6 is unlocked with the unlocking information and allows the various devices in the upper unit 2*a* to be drawn from the body of the upper unit 2*a*.

Consequently, a user who has specific authority of knowing the personal identification number of the locking unit 6 can access the inside of the upper unit 2*a*. For example, the user who has the specific authority can access the various devices in the upper unit 2*a*.

The lower unit 2*b* has an door 7*a* to be opened or closed, and a locking unit 7*b*. The door 7*a* is a door for accessing the inside of the lower unit 2*b*.

On a front surface of the door 7*a*, the locking unit 7*b* is provided. The locking unit 7*b* is, for example, an electronic lock, and limits access to the inside of the lower unit 2*b*. For example, when a preset personal identification number preset as unlocking information is input to the locking unit 7*b*, the locking unit 7*b* is unlocked and the door 7*a* can be opened.

Consequently, a user who has specific authority of knowing the personal identification number of the locking unit 7*b* can access the inside of the lower unit 2*b*. For example, the user who has the specific authority can access a temporary storage unit or a safe (for example, refer to a temporary storage unit 14 or a safe 15 illustrated in FIG. 2) inside lower unit 2*b* described below.

The aforementioned locking units 6, 7*b* are not limited to the electronic locks. The locking units 6, 7*b* may be locks such as cylinder locks.

Figure 2:
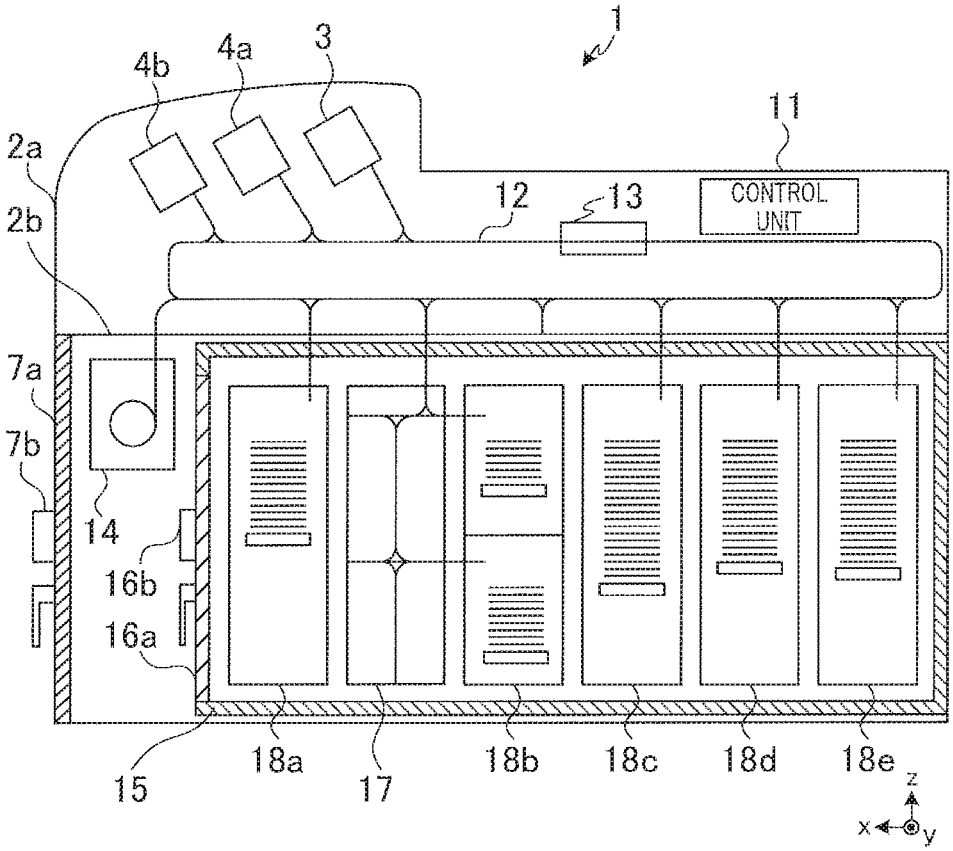
FIG. 2 is a schematic sectional of the banknote processing apparatus of FIG. 1 as viewed from the +y axis direction.

FIG. 2 is a schematic sectional view of the banknote processing apparatus 1 of FIG. 1 as viewed from the axis direction. In FIG. 2, the same components as FIG. 1 are denoted by the same reference numerals. In FIG. 2, illustration of the shape and the like of the banknote processing apparatus 1 of FIG. 1 is simplified.

As illustrated in FIG. 2, the upper unit 2*a* of the banknote processing apparatus 1 has the control unit 11, the transport unit 12, and the recognition unit 13.

The control unit 11 controls the whole of the banknote processing apparatus 1. For example, the control unit 11 performs depositing of banknotes deposited in the depositing unit 3. Specifically, the control unit 11 causes the transport unit 12 to transport the banknotes deposited in the depositing unit 3 to the recognition unit 13. The control unit 11 causes the recognition unit 13 to recognize authenticity, fitness, denomination, or the like of the banknotes. The control unit 11 temporarily stores normal banknotes and the like in the temporary storage unit 14 of the lower unit 2*b* on the basis of a recognition result of the recognition unit 13, and transports rejected banknotes to the dispensing units 4*a*, 4*b*. Then, for example, when a user performs deposit determination operation or the like, the control unit 11 transports the banknotes temporarily stored in the temporary storage unit 14 to the banknote storage units 18*a* to 18*e*.

The control unit 11 performs dispensing of the banknotes stored in the banknote storage units 18*a* to 18*e*, for example. Specifically, the control unit 11 feeds out banknotes in response to a dispensing request from the user from the banknote storage units 18*a* to 18*e*. The control unit 11 causes a transport module 17 and the transport unit 12 to transport the fed banknotes to the dispensing units 4*a*, 4*b*. The control unit 11 implements the aforementioned function by a device including a CPU (Central Processing Unit), a memory that stores a program and a predetermined data, and the like, for example.

The transport unit 12 has a loop-shaped transport path. The transport unit 12 is connected to the depositing unit 3, the dispensing units 4*a*, 4*b*, the temporary storage unit 14, the transport module 17, and the banknote storage units 18*a* to 18*e*. The transport unit 12 transports the banknotes to each unit in response to an instruction of the control unit 11.

The recognition unit 13 is provided on the transport unit 12. The recognition unit 13 includes an image sensor, an infrared sensor, an ultraviolet sensor, a magnetic sensor, or the like, and recognizes authenticity, fitness, denomination or the like of banknotes that are transported on the transport unit 12.

The lower unit 2*b* has the temporary storage unit 14, the safe 15, an door 16*a* to be opened or closed, a locking unit 16*b*, the transport module 17, and the banknote storage units 18*a* to 18*e*.

The temporary storage unit 14 temporarily stores banknotes put into the depositing unit 3, for example. Additionally, the temporary storage unit 14 temporarily stores a rejected banknote or the like caused at the time of dispensing, for example. The temporary storage unit 14 is a winding type storage unit having a winding drum which winds a banknote, for example.

The temporary storage unit 14 is disposed in the lower unit 2*b*. For example, the temporary storage unit 14 is installed in a space between a front surface of the safe 15 of the lower unit 2*b*, and the door 7*a*. In other words, the temporary storage unit 14 is disposed outside the safe 15 and inside the lower unit 2*b*.

Herein, the upper unit 2*a* has various devices such as the depositing unit 3, the dispensing units 4*a*, 4*b*, the control unit 11, the transport unit 12, and the recognition unit 13. Therefore, when the temporary storage unit 14 is disposed in the upper unit 2*a*, the temporary storage unit 14 is mingled with the various devices, and it is difficult for the user to access the temporary storage unit 14. Specifically, even when the locking unit 6 is unlocked and the various devices in the upper unit 2*a* is drawn out forward, there is a case where the various devices such as the depositing unit 3, the dispensing units 4*a*, 4*b*, the control unit 11, the transport unit 12, and the recognition unit 13 become obstacles, and the temporary storage unit 14 is disposed so as to be unlikely to be accessed from outside. Therefore, it becomes difficult to perform work for removing a banknote retaining in the temporary storage unit 14, or replacing parts of the temporary storage unit 14.

However, as described above, the temporary storage unit 14 is disposed in the lower unit 2*b* that does not has the various devices such as the depositing unit 3, the dispensing units 4*a*, 4*b*, the control unit 11, the transport unit 12, and the recognition unit 13 therein. More specifically, as described above, the temporary storage unit 14 is disposed in a space between the front surface of the safe 15, and the door 7*a*. Once the locking unit 7*b* is unlocked and the door 7*a* is opened, the temporary storage unit 14 is brought into a state of being exposed to the outside.

Consequently, the user can easily access the temporary storage unit 14, and can easily perform maintenance of the temporary storage unit 14. More specifically, when the user opens the door 7*a*, the user can access the temporary storage unit 14, and can easily perform maintenance of the temporary storage unit 14.

The safe 15 houses the transport module 17, and the banknote storage units 18*a* to 18*e*. The safe 15 has the door

16*a* and the locking unit 16*b* on the front surface. When the locking unit 16*b* is unlocked and the door 16*a* is opened, the inside of the safe 15 can be accessed.

The locking unit 16*b* is provided on a front surface of the door 16*a*. The locking unit 16*b* is, for example, an electronic lock, and limits access to the inside of the safe 15 when the door 16*a* is closed and the locking unit 16*b* is locked. For example, when a preset personal identification number is input to the locking unit 16*b*, the locking unit 16*b* is unlocked and the door 16*a* can be opened.

Consequently, a user who has specific authority of knowing the personal identification number of the locking unit 16*b* can access the inside of the safe 15. For example, the user who has the specific authority can access the banknote storage units 18*a* to 18*e* housed in the safe 15.

The transport module 17 is housed in the safe 15. The transport module 17 is detachable from the safe 15. The transport module 17 has a transport path connecting the transport unit 12 and a banknote storage unit 18*b*.

The temporary storage unit 14 is a storage unit that stores a banknote therein. The banknote storage units 18*a* to 18*e* each are also a storage unit that stores a banknote therein. In Embodiment 1, these storage units are collectively disposed in the lower unit 2*b*. On the other hand, a storage unit that stores a banknote therein is not disposed in the upper unit 2*a*. Thus, the banknote processing apparatus 1 has functionally distinguished units, namely, the lower unit 2*b* having a storage function, and the upper unit 2*a* having a processing function such as depositing and dispensing, and recognition of a banknote.

Figure 3:
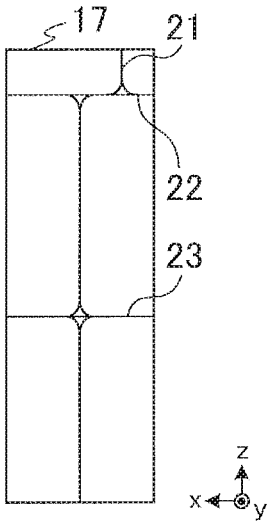
FIG. 3 is a schematic sectional view of a transport nodule as viewed from the +y axis direction.

FIG. 3 is a schematic sectional view of the transport module 17 as viewed from the +y axis direction. As illustrated in FIG. 3, the transport module 17 has transport units (transport paths) 21 to 23.

In a state in which the transport module 17 is attached to the safe 15 (for example, the state illustrated in FIG. 2), the transport unit 21 illustrated in FIG. 3 is connected to a transport unit connected to a transport unit 12 of FIG. 2. The transport unit 22 illustrated in FIG. 3 is connected to a transport unit connected to a storage unit on an upper side of the banknote storage unit 18*b* of FIG. 2. The transport unit 23 illustrated in FIG. 3 is connected to a transport unit connected to a storage unit on a lower side of the banknote storage unit 18*b* of FIG. 2.

The transport module 17 has a plurality of diverters that switch banknote transport routes. The transport module 17 switches transport destinations of a banknote in accordance of control of the diverters by the control unit 11.

For example, the transport module 17 transports a banknote transported from the transport unit 12 of FIG. 2 to the transport unit 22 to transport the banknote to the storage unit on the upper side of the banknote storage unit 18*b* of FIG. 2, or transports a banknote transported from the transport unit 12 of FIG. 2 to the transport unit 23 to transport the banknote to the storage unit on the lower side of the banknote storage unit 18*b* of FIG. 2. The transport module 17 transports the banknote fed out from the storage unit on the upper side of the banknote storage unit 18*b* of FIG. 2 to the transport unit 21 to transport the banknote to the transport unit 12 of FIG. 2, or transports the banknote fed out from the storage unit on the lower side of the banknote storage unit 18*b* of FIG. 2 to the transport unit 21 to transport the banknote to the transport unit 12 of FIG. 2.

The transport module 17 can be replaced with one of the banknote storage units 18*a* to 18*e* illustrated in FIG. 2. For example, the transport module 17 can be mounted at a position of the banknote storage unit 18*c* illustrated in FIG. 2. In this case, at a position of the banknote storage unit 18*d* of FIG. 2, the banknote storage unit 18*b* including the two storage units are located. That is, the banknote processing apparatus 1 can flexibly compose the transport path and the banknote storage units by the detachable transport module 17.

The explanation of FIG. 2 will be continued. The banknote storage units 18*a* to 18*e* are housed in the safe 15. The banknote storage units 18*a* to 18*e* are detachable from the safe 15.

The banknote storage units 18*a*, 18*c* to 18*e* each have an opening for storing and feeding out a banknote in an upper surface. The banknote storage units 18*a*, 18*c* to 18*e* each store the banknote transported from the transport unit 12, from the opening provided in the upper surface. Additionally, the banknote storage units 18*a*, 18*c* to 18*e* each feed out the stored banknote from the opening provided on the upper surface to the transport unit 12.

The banknote storage unit 18*b* has the two storage unit in the vertical direction (z-axis direction). The banknote storage unit 18*b* has an opening for storing and feeding out a banknote in a side surface in each of the two storage units. The banknote storage unit 18*b* stores the banknote transported from the transport module 17, from the opening provided in the side surface. Additionally, the banknote storage unit 18*b* feeds out the stored banknote from the opening provided in the side surface to the transport module 17.

The transport module 17 and the banknote storage units 18*a* to 18*e* are installed on a rail (not illustrated) provided on a bottom surface inside the safe 15 so as to be movable in the front surface and back surface directions of the safe 15 (x-axis direction)), for example. Consequently, the user can take out the transport module 17 and the banknote storage units 18*a* to 18*e* to the outside of the safe 15. For example, the user opens the door 7*a* of the lower unit 2*b*, removes the temporary storage unit 14, and opens the door 16*a* of the safe 15, so that the user can take out the transport module 17 and the banknote storage units 18*a* to 18*e* to the outside of the safe 15. Additionally, the user can house, in the safe 15, the transport module 17 and the banknote storage units 18*a* to 18*e* taken out to the outside of the safe 15.

Management authority of the banknote processing apparatus 1 will be described. First, the upper unit 2*a* and the lower unit 2*b* have the locking unit 6 and the locking unit 7*b*, respectively, as illustrated in FIG. 1. Consequently, the upper unit 2*a* and the lower unit 2*b* are managed under different management authority, respectively.

Furthermore, the temporary storage unit 14 and the banknote storage units 18*a* to 18*e* in the lower unit 2*b* are disposed in respective regions isolated from each other by the safe 15 having the locking unit 16*b*. For example, the temporary storage unit 14 is disposed inside the lower unit 2*b* and outside the safe 15, and the banknote storage units 18*a* to 18*e* are disposed inside the lower unit 2*b* and inside the safe 15. Consequently, the temporary storage unit 14 and the banknote storage units 18*a* to 18*e* in the lower unit 2*b* are managed under different management authority, respectively.

Namely, the upper unit 2*a*, the temporary storage unit 14 of the lower unit 2*b*, the banknote storage units 18*a* to 18*e* of the lower unit 2*b* are managed under different management authority, respectively.

For example, the personal identification number of the locking unit 6 of the upper unit 2*a* is informed to a user who has authority to access the inside of the upper unit 2*a*. The personal identification number of the locking unit 7*b* for opening the door 7*a* of the lower unit 2*b* is informed to a user who has authority to access the temporary storage unit 14 of the lower unit 2*b*. The personal identification number of the locking unit 7*b* for opening the door 7*a* of the lower unit 2*b*, and the personal identification number of the locking unit 16*b* for opening the door 16*a* of the safe 15 are informed to a user who has authority to access the banknote storage units 18*a* to 18*e* of the lower unit 2*b*. Consequently, the upper unit 2*a*, the temporary storage unit 14, and the banknote storage units 18*a* to 18*e* are managed under different management authority, respectively.

For example, in a case in which the locking units 6, 7*b*, 16*b* are cylinder keys of the cylinder locks only need to be given to the respective users who have the management authority of the upper unit 2*a*, the management authority of the temporary storage unit 14, and the management authority of the banknote storage units 18*a* to 18*e*.

The personal identification numbers of the locking units 6, 7*b*, 16*b* as the keys are different from each other such that the user having each management authority cannot access a portion of other management authority. In a case in which the locking units 6, 7*b*, 16*b* are the cylinder locks, the keys of the locking units 6, 7*b*, 16*b* are different in each management authority.

As described above, the upper unit 2*a* of the banknote processing apparatus 1 has the depositing unit 3 in which banknotes are deposited, and the recognition unit 13 that recognizes the banknotes deposited from the depositing unit 3. The lower unit 2*b* has the temporary storage unit 14 that temporarily stores the banknotes recognized by the recognition unit 13, and the banknote storage units 18*a* to 18*e* each storing the banknote temporarily stored in the temporary storage unit 14. Thus, the temporary storage unit 14 is housed in the lower unit 2*b*, and therefore a user can easily perform maintenance of the temporary storage unit 14.

The temporary storage unit 14 is provided between the door 16*a* of the safe 15, and the door 7*a* of the lower unit 2*b*. Consequently, the height of the banknote processing apparatus 1 can be reduced compared to a case tri which the temporary storage unit 14 is disposed in the upper unit 2*a*. For example, the upper unit 2*a* houses various devices such as the depositing unit 3 and the recognition unit 13. Therefore, if the temporary storage unit 14 is disposed in the upper unit 2*a*, the height of the upper unit 2*a* is increased. On the other hand, the temporary storage unit 14 is provided between the door 16*a* of the safe 15 and the door 7*a* of the lower unit 2*b*, and therefore the height of the upper unit 2*a* can be reduced.

The banknote processing apparatus 1 has the locking unit 6 that limits access to the inside of the upper unit 2*a*, the locking unit 7*b* that limits access to the region where the temporary storage unit 14 is provided, and the locking unit 16*b* that limits access to the region where the banknote storage units 18*a* to 18*e* are provided. Consequently, it is possible to separate the management authority of the upper unit 2*a*, the management authority of the temporary storage unit 14 of the lower unit 2*b*, and the management authority of the banknote storage units 18*a* to 18*e* of the lower unit 2*b*.

As described above, when the control unit 11 temporarily stores, in the temporary storage unit 14, the banknotes deposited in the depositing unit 3, and a user performs deposit determination operation or the like, the banknotes temporarily stored in the temporary storage unit 14 are stored in the banknote storage units 18*a* to 18*e*. Accordingly, the banknotes in states before and after deposit determination are stored in the temporary storage unit 14.

Generally, banknote management authority before the deposit determination and banknote management authority after the deposit determination are different. Therefore, the temporary storage unit 14 is desirably disposed in a region where the management authority is clarified. In the banknote processing apparatus 1, the temporary storage unit 14 is disposed in a region between the door 7*a* having the locking unit 7*b* of the lower unit 2*b*, and the safe 15 having the locking unit 16*b*, and therefore it is possible to clarify the management authority of the temporary storage unit 14.

The temporary storage unit 14 is the winding type storage unit in the aforementioned description, but is not limited to this. For example, the temporary storage unit 14 may be a stack type storage unit.

Figure 4:
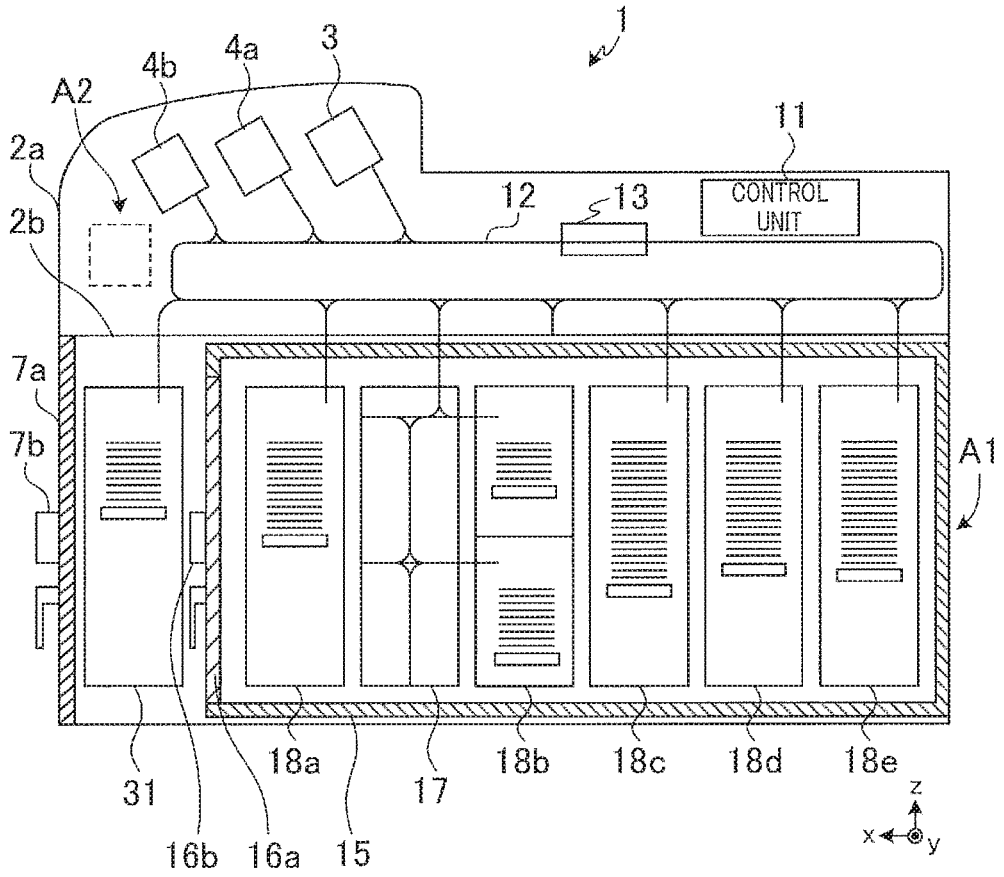
FIG. 4 is another schematic sectional view of the banknote processing apparatus of FIG. 1 as viewed from the +y axis direction.

FIG. 4 is another schematic sectional view of the banknote processing apparatus 1 of FIG. 1 as viewed from the +y axis direction. In FIG. 3, the same components as FIG. 2 are denoted by the same reference numerals.

As illustrated in FIG. 4, the banknote processing apparatus 1 has a stack type temporary storage unit 31. The temporary storage unit 31 stacks and stores banknotes in the direction perpendicular to a printing surface.

Thus, the temporary storage unit 14 may be a stack type storage unit. Also, in this case, similarly to the winding type storage unit, for example, banknotes put into the depositing unit 3 can be temporarily stored, or a rejected banknote or the like caused at the time of dispensing can be temporarily stored. The stack type storage unit is used as the temporary storage unit 14, so that the number of banknotes to be stored can be increased compared to the winding type storage unit. The number of banknotes to be stored in the temporary storage unit 14 is equal to or more than the number of banknotes to be stored in the banknote storage unit 18*a*, so that banknotes in the banknote storage units 18*a* to 18*e* can be collected, or banknotes can be replenished in the banknote storage units 18*a* to 18*e*. Furthermore, the temporary storage unit 14 may have the same configuration as the banknote storage units 18*a* to 18*e*.

The door 16*a* of the safe 15 is provided on the front surface of the safe 15 in the aforementioned description, but may be provided on a back surface of the safe 15. For example, an door for accessing the inside of the safe 15, and a locking unit for locking the door may be provided on the back surface of the safe 15 illustrated by the arrow A1 of FIG. 4. In this case, a user who has management authority of the temporary storage unit 31 accesses from a front surface of the banknote processing apparatus 1, and a user who has management authority of the banknote storage units 18*a* to 18*e* accesses from a back surface of the banknote processing apparatus 1. Thus, the door and the locking unit of the safe 15 are provided on the back surface illustrated by the arrow A1, so that management authority of the temporary storage unit 31, and management authority of the banknote storage units 18*a* to 18*e* can be regulated from the direction with respect to the banknote processing apparatus 1.

The temporary storage unit 31 conventionally disposed in the upper unit 2*a* is disposed in the lower unit 2*b*. Consequently, a box may be disposed in a space for the temporary storage unit 31 disposed in the upper unit 2*a*. For example, a box may be disposed in a space illustrated by a dotted line indicated by the arrow A2 of FIG. 4. For example, the box may store a rejected banknote, or store a banknote suspected to be a counterfeit banknote. The box may be a box dedicated to storage with no feeding function. One or more boxes may be provided in the upper unit 2*a*. In a case in which the box is the box dedicated to storage with no feeding function, the banknote processing apparatus 1 has functionally distinguished units, namely the lower unit 2*b* having a feeding and storing function, and the upper unit 2*a* having a processing function such as depositing and dispensing and recognition of a banknote and a storage function.

The banknote processing apparatus 1 has the three locking units 6, 7*b*, 16*b*, and therefore a user who uses the banknote processing apparatus 1 can freely determine how to allocate the management authority of the banknote processing apparatus 1.

For example, in a case in which the management authority of the banknote processing apparatus 1 is divided into two, namely management authority of the upper unit 2*a* and management authority of the lower unit 2*b*, the personal identification number of the locking unit 6 is informed to a user who has the management authority of the upper unit 2*a*. The personal identification number of the locking unit 7*b* and the personal identification number of the locking unit 16*b* are informed to a user who has the management authority of the lower unit 2*b*. In a case in which the management authority of the banknote processing apparatus 1 is divided into three, namely management authority of the upper unit 2*a*, management authority of the temporary storage unit 14, and the management authority of the banknote storage units 18*a* to 18*e*, the personal identification number of the locking unit 6 is informed to a user who has the management authority of the upper unit 2*a*. The personal identification number of the locking unit 7*b* is informed to a user who has the management authority of the temporary storage unit 14. The two personal identification numbers of the locking units 7*b*, 16*b* are informed to a user who has the management authority of the banknote storage units 18*a* to 18*e*.

The banknote processing apparatus 1 has the locking unit 6 that limits access to the inside of the upper unit 2*a*, the locking unit 7*b* of the door 7*a* of the lower unit 2*b* for limiting access to a region where the temporary storage unit 14 is provided, and the locking unit 16*b* of the safe 15 for limiting access to regions where the banknote storage units 18*a* to 18*e*. However, the present invention is not limited to this. For example, the locking unit is provided in the temporary storage unit 14 itself, so that access to the inside of the temporary storage unit 14 can be limited. In this case, even when any one of the locking unit 7*b* and the locking unit 16*b* is omitted, similar management authority can be provided. In a case in which management authority (for example, authority to enter a room) of a space where the banknote processing apparatus 1 is installed and management authority of the upper unit 2*a* are equal, the locking unit 6 may be omitted. In a case in which management authority of the space where the banknote processing apparatus 1 is installed and management authority of the temporary storage unit 14 are equal, the locking unit 7*b* may be omitted. In a case in which management authority of the upper unit 2*a* and management authority of the temporary storage unit 14 are equal, the locking unit 6 and the locking unit 7*b* may be locking units that can be unlocked by the same key. In a case in which management authority of the temporary storage unit 14 and management authority of the banknote storage units 18*a* to 18*e* are equal, the locking unit 7*b* and the locking unit 16*b* may be locking units that can be unlocked by the same key, or the locking unit 16*b* may be omitted.

Thus, a locking unit that limits access to the inside may be provided in at least one of the upper unit 2*a*, the lower unit 2*b*, the temporary storage unit 14, and the banknote storage units 18*a* to 18*e*. Furthermore, locking units may be provided in at least two of the upper unit 2*a*, the lower unit 2*b*, the temporary storage unit 14, and the banknote storage units 18*a* to 18*e*, and respective keys for unlocking or respective pieces of information to be input to unlock in these locking units may be different.

Embodiment 2

In Embodiment 2, a method for attaching to a lower unit 2*b* according to a structure of a winding type temporary storage unit will be described.

Figure 5:
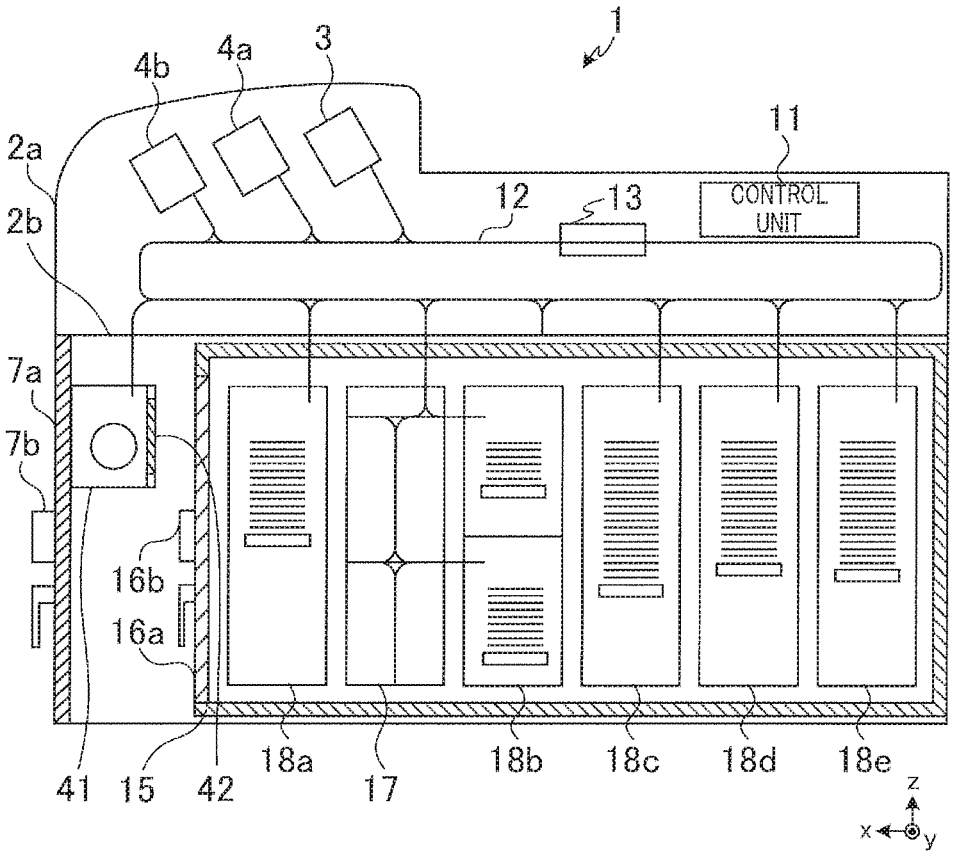
FIG. 5 is a schematic sectional view of a banknote processing apparatus according to Embodiment 2 as viewed from the +y axis direction.

FIG. 5 is a schematic sectional view of a banknote processing apparatus 1 according to Embodiment 2 as viewed from the +y axis direction. In FIG. 5, the same components as FIG. 2 are denoted by the same reference numerals.

As illustrated in FIG. 5, the lower unit 2*b* of the banknote processing apparatus 1 has a winding type temporary storage unit 41. The temporary storage unit 41 is provided on an inner side of an door 7*a* of the lower unit 2*b*. Although description will be made below (for example, refer to FIG. 7), the temporary storage unit 41 is provided on the inner side of the door 7*a* in such a manner as to enable access to the inner face of a banknote to be wound, when the door 7*a* is opened.

The temporary storage unit 41 has an isolation member that isolates the inside of the temporary storage unit from the outside. The isolation member is, for example, a door 42. The door 42 is a door for accessing the inside of the temporary storage unit 41. The door 42 is provided on a surface (surface on a safe 15 side) on a side opposite to a surface fixed to the door 7*a* of the temporary storage unit 41.

Figure 6:
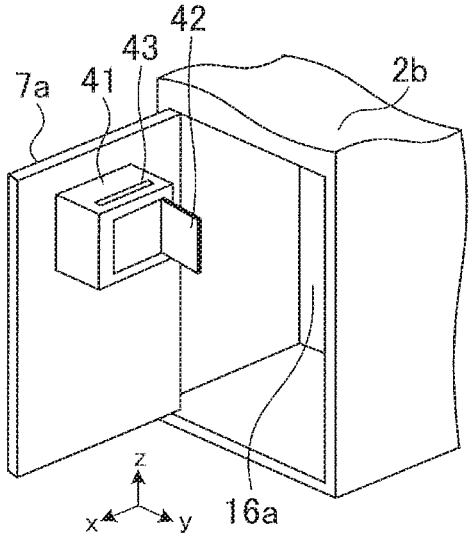
FIG. 6 is a schematic perspective view of a temporary storage unit when a door of a lower unit is opened.

FIG. 6 is a schematic perspective view of the temporary storage unit 41 when the door 7*a* of the lower unit 2*b* is opened. In FIG. 6, the same components as FIG. 5 are denoted by the same reference numerals. In FIG. 6, the door 7*a* of the lower unit 2*b*, and an door 16*a* of the safe 15 are illustrated in addition to the temporary storage unit 41.

As illustrated in FIG. 6, the temporary storage unit 41 is fixed to the inner side of the door 7*a*. Accordingly, when the door 7*a* is opened, the temporary storage unit 41 appears from the inner side of the lower unit 2*b*.

FIG. 6 illustrates the temporary storage unit 41 in a state in which the door 42 is open. As illustrated in FIG. 6, a user can access the inside of the temporary storage unit 41 by opening the door 42. That is, the user can perform maintenance of the temporary storage unit 41 by opening the door 7*a* of the lower unit 2*b* and opening the door 42 of the temporary storage unit 41.

The temporary storage unit 41 has an opening 43 in an upper surface. The temporary storage unit 41 stores, from the opening 43, a banknote transported from a transport unit 12, and temporarily stores the banknote in a state in which the door 7*a* is closed (for example, in a state of the door 7*a* illustrated in FIG. 5). Additionally, the temporary storage unit 41 feeds out the banknote temporarily stored, from the opening 43 to the transport unit 12.

Figure 7:
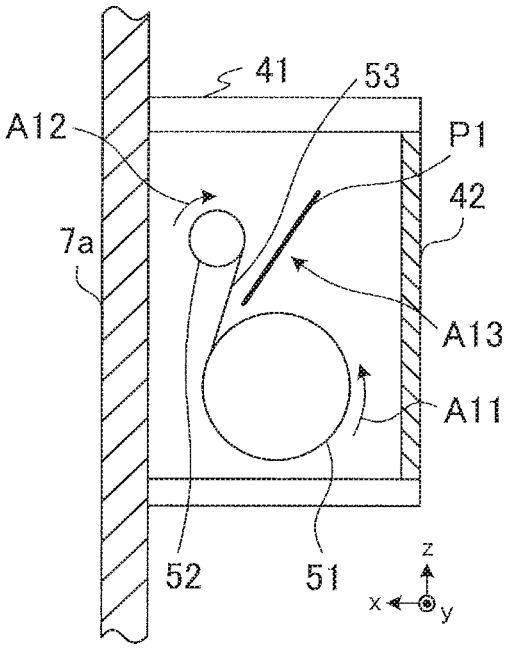
FIG. 7 is a schematic sectional view of the temporary storage unit as viewed from the +y axis direction.

FIG. 7 is a schematic sectional view of the temporary storage unit 41 as viewed from the +y axis direction. In FIG. 7, the same components as FIG. 5 are denoted by the same reference numerals. As illustrated in FIG. 7, the temporary storage unit 41 has drums 51, 52, and a tape 53. FIG. 7 also illustrates a banknote P1 temporarily stored in the temporary storage unit 41.

In a case in which the banknote P1 is temporarily stored, the drum 51 rotates in the arrow A11 direction of FIG. 7. In a case in which the banknote P1 is temporarily stored, the drum 52 around which the tape 53 is wound rotates in the arrow A12 direction of FIG. 7. The tape 53 wound around the drum 52 fed out to the drum 51 by rotation illustrated by the arrow A12 of FIG. 7, and the tape 53 fed out to the drum 51 is wound around the drum 51 by rotation illustrated by the arrow A11 of FIG. 7.

In a case in which the banknote P1 is temporarily stored in the temporary storage unit 41, the banknote P1 is transported between the tape 53 and outer periphery of the drum 51 by a transport unit (not illustrated) inside the temporary storage unit 41. The banknote P1 is sandwiched between the tape 53 and the outer periphery of the drum 51 to be wound around the drum 51.

The arrow A13 of FIG. 7 illustrates a surface of the banknote P1, the surface being in contact with the outer periphery of the drum 51. That is, the arrow A13 illustrates the inner face of the banknote P1 which is wound around the drum 51.

As described above, the temporary storage unit 41 is provided on the inner side of the door 7*a* in such a manner as to enable access to the inner face of the banknote P1 to be wound (surface illustrated by the arrow A13) when the door 7*a* is opened. Therefore, when the door 7*a* of the lower unit 2*b* is opened and the door 42 of the temporary storage unit 41 is opened, the tape 53 does not exist on a surface of the banknote P1 before winding or in the middle of the winding, the surface being illustrated by the arrow A13. Consequently, for example, even when a jam of banknotes occurs inside the temporary storage unit 41, the user can easily perform maintenance. Feeding operation of a banknote of the temporary storage unit 41 is operation reverse to the aforementioned storing operation.

On the other hand, as described below, in a case in which the temporary storage unit 41 is provided on the inner side of the door 7*a* in such a manner as to prevent access to the inner face of the banknote P1 to be wound, maintenance becomes difficult.

Figure 8:
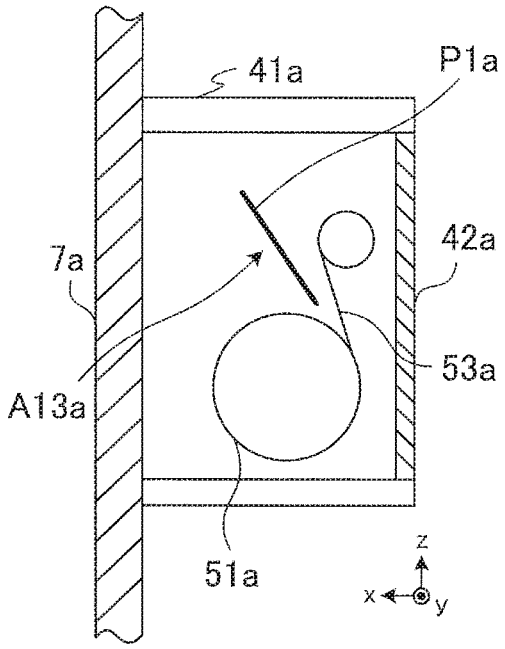
FIG. 8 is a schematic sectional view of a temporary storage unit for comparison with the temporary storage unit of FIG. 7.

FIG. 8 is a schematic sectional view of a temporary storage unit 41*a* for comparison with the temporary storage unit 41 of FIG. 7. The temporary storage unit 41*a* illustrated in FIG. 8 is different from the temporary storage unit 41 illustrated in FIG. 7 in that the inner face of a banknote P1*a* to be wound around a drum 51*a* (surface illustrated by the arrow A13*a*) is directed to an door 7*a* side. Therefore, when the door 7*a* of a lower unit 2*b* is opened and an door 42*a* of the temporary storage unit 41*a* is opened, the banknote P1*a* exists on the other side of a tape 53*a*.

Accordingly, in arrangement like the example of FIG. 8, for example, when a jam of banknotes occurs inside the temporary storage unit 41*a*, a user cannot easily access the banknote P1*a*, and maintenance becomes difficult.

As described above, when the door 7*a* is opened, the winding type temporary storage unit 41 is disposed on the inner side of the door 7*a* in such a manner as to enable access to the inner face of the banknote to be wound. Consequently, the user can easily perform maintenance of the, temporary storage unit 41.

Embodiment 3

In Embodiment 3, a method for attaching to a lower unit 2*b* of a stack type temporary storage unit will be described.

Figure 9:
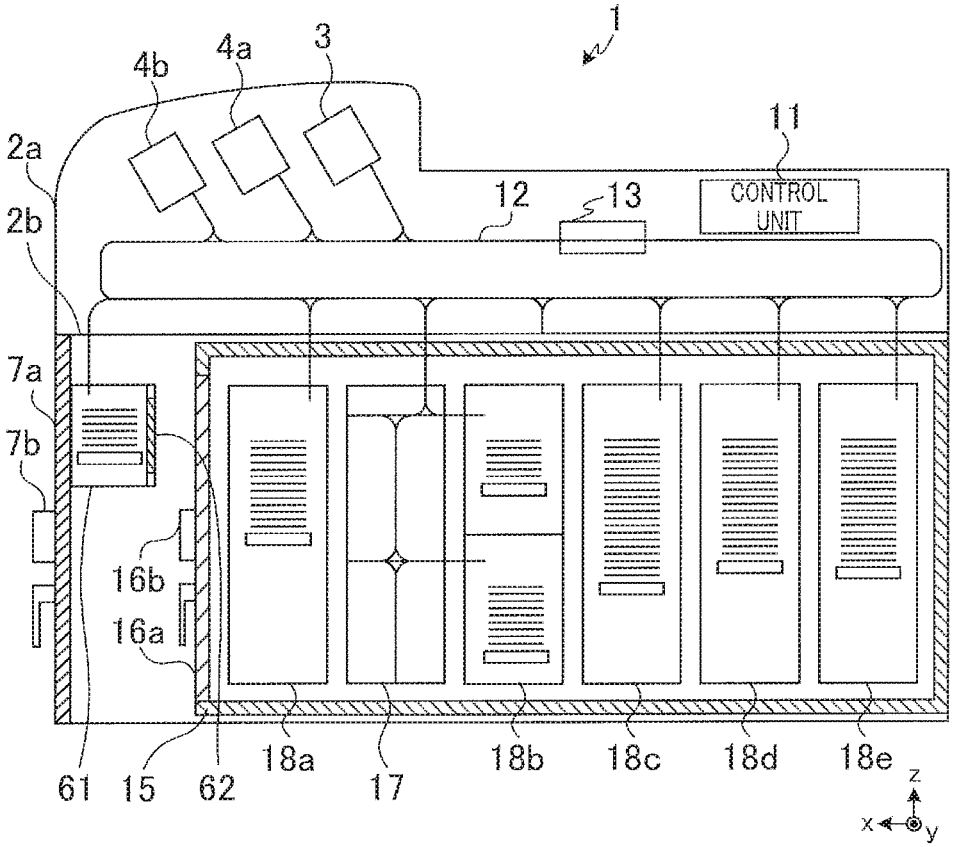
FIG. 9 is a schematic sectional view of a banknote processing apparatus according to Embodiment 3 as viewed from the +y axis direction.

FIG. 9 is a schematic sectional view of a banknote processing apparatus 1 according to Embodiment 3 as viewed from the +y axis direction. In FIG. 9, the same components as FIG. 2 are denoted by the same reference numerals.

As illustrated in FIG. 9, the lower unit 2*b* of the banknote processing apparatus 1 has a stack type temporary storage unit 61. The temporary storage unit 61 is provided on an inner side of an door 7*a* of the lower unit 2*b*. The temporary storage unit 61 has a door 62 to be opened or closed for accessing a banknote housed therein.

When a user opens the door 7*a*, the temporary storage unit 61 is fixed to the inner side of the door 7*a* of the lower unit 2*b* in such a manner as to enable access to the door 62.

Figure 10:
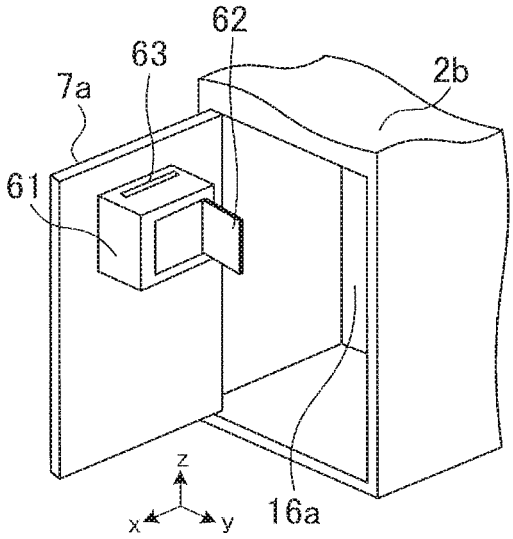
FIG. 10 is a schematic perspective view of a temporary storage unit when a door of a lower unit is opened.

FIG. 10 is a schematic perspective view of the temporary storage unit 61 when the door 7*a* of the lower unit 2*b* is opened. In FIG. 10, the same components as FIG. 9 are denoted by the same reference numerals. In FIG. 10, the door 7*a* of the lower unit 2*b* and an door 16*a* of a safe 15 are illustrated in addition to the temporary storage unit 61.

As illustrated in FIG. 10, the temporary storage unit 61 is fixed to the inner side of the door 7*a*. Accordingly, when the door 7*a* is opened, the temporary storage unit 61 appears from the inner side of the lower unit 2*b*.

FIG. 10 illustrates the temporary storage unit 61 in a state in which the door 62 is open. As illustrated in FIG. 10, a user can access the inside of the temporary storage unit 61 by opening the door 62. That is, the user can perform maintenance of the temporary storage unit 61 by opening the door 7*a* of the lower unit 2*b* and opening the door 62 of the temporary storage unit 61.

The temporary storage unit 61 has an opening 63 in an upper surface. The temporary storage unit 61 stores, from the opening 63, a banknote transported from a transport unit 12, and temporarily stores the banknote in a state in which the door 7*a* is closed (for example, in a state of the door 7*a* illustrated in FIG. 9). Additionally, the temporary storage unit 61 feeds out, from the opening 63 to the transport unit 12, the temporarily stored banknote.

As described above, the temporary storage unit 61 has the door 62 for taking out the stored banknote, and is disposed on the door 7*a* in such a manner as to enable access to the door 62 when the door 7*a* of the lower unit 2*b* is opened. Consequently, the user can easily perform maintenance of the temporary storage unit 61 by opening the door 7*a* of the lower unit 2*b* and the opening the door 62 of the temporary storage unit 61.

Embodiment 4

In Embodiment 3, the door 62 of the stack type temporary storage unit 61 is provided on a surface on the safe 15 side of the temporary storage unit 61, as illustrated in FIG. 9. In Embodiment 4, an door of a stack type temporary storage unit is provided on a surface on an door 7*a* side of a lower unit 2*b* of the temporary storage unit.

Figure 11:
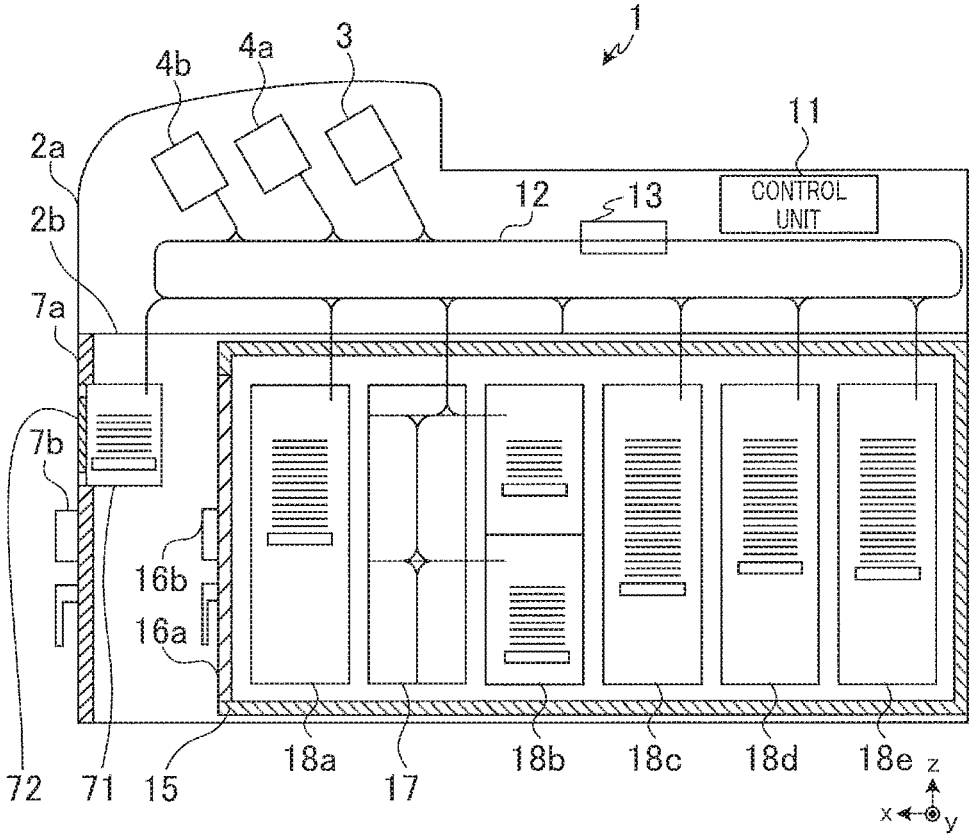
FIG. 11 is a schematic sectional view of a banknote processing apparatus according to Embodiment 4 as viewed from the +y axis direction.

FIG. 11 is a schematic sectional view of a banknote processing apparatus 1 according to Embodiment 4 as viewed from the +y axis direction. In FIG. 11, the same components as FIG. 9 are denoted by the same reference numerals.

As illustrated in FIG. 11, the lower unit 2*b* of the banknote processing apparatus 1 has a stack type temporary storage unit 71. The temporary storage unit 71 is provided on the inner side of the door 7*a* of the lower unit 2*b*. The temporary storage unit 71 has a door 72 for accessing a banknote housed therein.

The temporary storage unit 71 is fixed to the inner side of the door 7*a* of the lower unit 2*b* in such a manner as to enable a user to access the door 72 from a front surface of the door 7*a*.

Figure 12:
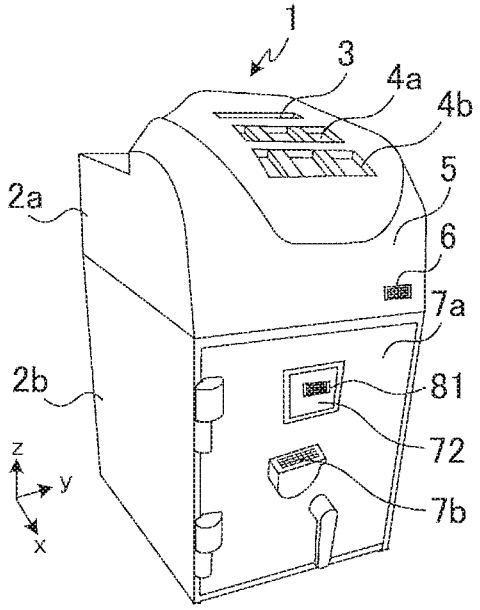
FIG. 12 is a perspective view of the banknote processing apparatus of FIG. 11.

FIG. 12 is a perspective view of the banknote processing apparatus 1 of FIG. 11. In FIG. 12, the same components as FIG. 11 are denoted by the same reference numerals.

As illustrated in FIG. 12, the door 72 of the temporary storage unit 71 can be accessed from a front surface of the lower unit 2*b*. A locking unit 81 is provided on a front surface of the door 72.

The locking unit 81 is, for example, an electronic lock, and limits access to the inside of the temporary storage unit 71. For example, the door 72 of the temporary storage unit 71 cannot be opened when a preset personal identification number is not input to the locking unit 81.

As described above, the temporary storage unit 71 is disposed on the inner surface of the door 7*a* in such a manner as to enable access to the door 72 from the front surface of the door 7*a*. Consequently, even when the user does not open the door 7*a* of the lower unit 2*b*, the user can open the door 72 of the temporary storage unit 71, and can easily perform maintenance of the temporary storage unit 71.

Embodiment 5

In Embodiment 5, a temporary storage unit is housed in a safe.

Figure 13:
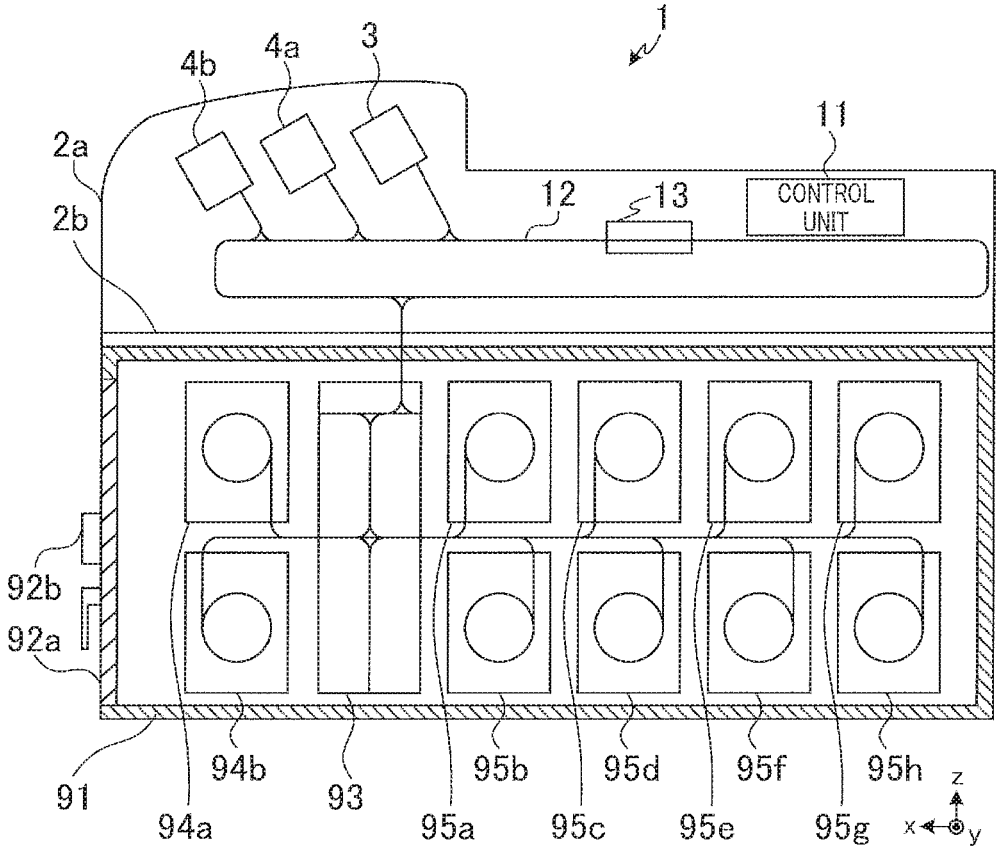
FIG. 13 is a schematic sectional view of a banknote processing apparatus according to Embodiment 5 as viewed from the +y axis direction.

FIG. 13 is a schematic sectional view of a banknote processing apparatus 1 according to Embodiment 5 as viewed from the +y axis direction. In FIG. 13, the same components as FIG. 2 are denoted by the same reference numerals.

As illustrated in FIG. 13, a lower unit 2*b* of the banknote processing apparatus 1 has a safe 91, a door 92*a*, a locking unit 92*b*, a transport module 93, temporary storage units 94*a*, 94*b*, and banknote storage units 95*a* to 95*h*.

The door 92*a* for accessing the inside of the safe 91 is provided on a front surface of the safe 91. The locking unit 92*b* is provided on a front surface of the door 92*a*.

The locking unit 92*b* is, for example, an electronic lock, and limits access to the inside of the safe 91. For example, the locking unit 92*b* cannot be opened when a preset personal identification number is not input to the locking unit 92*b*.

The transport module 93 is housed in the safe 91. The transport module 93 has a plurality of diverters that switch banknote transport routes, similarly to the transport module 17 described with reference to FIG. 2. The transport module 93 switches transport destinations of a banknote in accordance of control of the diverters by the control unit 11.

For example, the transport module 93 transports banknotes transported from a transport unit 12 of FIG. 13 to the temporary storage units 94*a*, 94*b*, or transports banknotes transported from the transport unit 12 of FIG. 13 to the banknote storage units 95*a* to 95*h*. Additionally, the transport module 93 transports the banknotes fed out from the temporary storage units 94*a*, 94*b* to the transport unit 12, or transports the banknotes fed out from the banknote storage units 95*a* to 95*h* to the transport unit 12.

The temporary storage units 94*a*, 94*b* are winding type temporary storage units. The temporary storage units 94*a*, 94*b* are housed in the safe 91. The temporary storage units 94*a*, 94*b* are detachable from the safe 91.

The banknote storage units 95*a* to 95*h* are winding type banknote storage units. The banknote storage units 95*a* to 95*h* are housed in the safe 91. The banknote storage units 95*a* to 95*h* are detachable from the safe 91.

As described above, the temporary storage units 94*a*, 94*b* are housed in the safe 91 housing the banknote storage units 95*a* to 95*h* therein. Consequently, maintenance of the temporary storage units 94*a*, 94*b* is facilitated.

Management authority of the safe 91 can be separated from management authority of the lower unit 2*b* by the locking unit 92*b*.

The banknotes transported by the transport unit 12 are transported to the temporary storage units 94*a*, 94*b* and the banknote storage units 95*a* to 95*h* through the transport module 93. Consequently, the safe 91 only needs to have an opening of the transport unit connecting the transport unit 12 and the transport module 93, and the banknote processing apparatus 1 can enhance security. For example, in a case of the example of FIG. 13, the safe 91 has a single opening for the transport unit connecting the transport unit 12 and the transport module 93. Consequently, the banknote processing apparatus 1 can enhance security.

A plurality of the temporary storage units 94*a*, 94*b* are provided so that the following processing can be performed. For example, in depositing, deposited banknotes can be classified into a plurality of the temporary storage units 94*a*, 94*b* and be temporarily stored on the basis of a recognition result. For example, deposited banknotes may be classified for each denomination, or may be classified for fitness. Only banknotes suspected to be counterfeit banknotes may be separately classified. Only banknotes to be regarded as rejected banknotes may be classified, and discharged to the dispensing unit 4*a* in a lamp. In depositing, in a case in which banknotes, the number of which exceeds the number of banknotes which can be stored in a single temporary storage unit, are deposited, the banknotes may be divided and temporarily stored in a plurality of the temporary storage units 94*a*, 94*b*. A plurality of the temporary storage units 94*a*, 94*b* may be alternately used on the basis of time or the number of stored banknotes.

The disclosure of the specification, the drawings, and the abstract included in Japanese Patent Application No. 2017-049787 filed on Mar. 15, 2017 is incorporated herein by reference as if set forth in its entirety.

REFERENCE SIGNS LIST

1 Banknote processing apparatus
2*a* Upper unit
2*b* Lower unit
6 Locking unit
7*a* door
7*b* Locking unit
11 Control unit
12 Transport unit
13 Recognition unit
14 Temporary storage unit
15 Safe
16*a* door
16*b* Locking unit
17 Transport module
18*a* to 18*e* Banknote storage unit

The invention claimed is:

1. A banknote processing apparatus, comprising:

an upper unit including a depositing unit which has an inlet and is configured to deposit a banknote through the inlet in the banknote processing apparatus; and a lower unit including a safe, a first storage and a second storage, the first storage being disposed outside of the safe and inside of the lower unit, the second storage being housed inside of the safe, the first storage and the second storage being configured to store the banknote deposited through the inlet in the banknote processing apparatus, wherein the lower unit further comprising:

a first door to be opened and closed, and a first lock which is provided on a front surface of the first door and configured to limit access to inside of the lower unit, the safe further comprising:

a second door to be opened and closed, and a second lock which is provided on a front surface of the second door and configured to limit access to inside of the safe, wherein each of the first lock and the second lock is capable of unlocking with a key or a piece of unlocking information that is input to each of the first lock and the second lock, and each key to each of the first lock and the second lock or each piece of information input to each of the first lock and the second lock is different from each other, wherein the first door is configured to isolate inside of the lower unit from outside of the lower unit, wherein the first storage is a winding type storage that is disposed on an inner side of the first door in such a manner as to enable access to a banknote to be wound, when the first door is opened, or the first storage is a stack type storage that has an isolation member that isolates inside of the first storage from outside of the first storage, and is disposed on an inner side of the first door in such a manner as to enable access to the isolation member when the first door is opened.

2. The banknote processing apparatus according to claim 1, wherein the upper unit and the lower unit are managed, respectively, under a first management authority and a second management authority which are different from each other, wherein an inside of the upper unit and an inside of the lower unit are capable of being accessed by a first user having the first management authority and a second user having the second management authority, respectively.

3. The banknote processing apparatus according to claim 2, wherein:

the first storage is managed under the second management authority, and the second storage is managed under a third management authority being different from the first management authority and the second management authority.

4. The banknote processing apparatus according to claim 1, wherein the second door is configured to isolate inside of the safe from outside of the safe.

5. The banknote processing apparatus according to claim 4, wherein the first door is configured to isolate inside of the lower unit from outside of the lower unit.

6. The banknote processing apparatus according to claim 1, wherein the upper unit further includes an upper cover and a third lock, wherein the upper cover is configured to cover at least a front surface of the upper unit, and the third lock is provided on a front surface of the upper cover and configured to limit access to inside of the upper unit, wherein each of the first lock, the second lock and the third lock is capable of unlocking with a key or a piece of unlocking information that is input to each of the first lock, the second lock and the third lock, and each key to each of the first lock, the second lock and the third lock or each piece of information input to each of the first lock, the second lock and the third lock is different from each other.

7. The banknote processing apparatus according to claim 1, further comprising:

a control unit configured to control the banknote processing apparatus, wherein the first storage is a temporary storage configured to temporarily store therein the banknote deposited through the inlet in the banknote processing apparatus, and the control unit is configured to control the banknote processing apparatus such that the banknote is deposited though the inlet in the banknote processing apparatus, the deposited banknote is stored in the temporary storage, and then the stored banknote is transported to the second storage.

* * * * *